US011904378B2

(12) United States Patent
Rouweler et al.

(10) Patent No.: US 11,904,378 B2
(45) Date of Patent: Feb. 20, 2024

(54) DEVICE FOR SECURING A TOOL AND METHOD FOR MANUFACTURING SUCH A DEVICE

(71) Applicant: Wila B.V., Lochem (NL)

(72) Inventors: Franciscus Wilhelmus Rouweler, Arnhem (NL); Huub Hubertus Johannes Kienhuis, Almelo (NL)

(73) Assignee: Wila B. V., Lochem (NL)

( * ) Notice: Subject to any disclaimer, the term of this patent is extended or adjusted under 35 U.S.C. 154(b) by 0 days.

(21) Appl. No.: 16/481,361

(22) PCT Filed: Feb. 19, 2018

(86) PCT No.: PCT/NL2018/050109
§ 371 (c)(1),
(2) Date: Jul. 26, 2019

(87) PCT Pub. No.: WO2018/151600
PCT Pub. Date: Aug. 23, 2018

(65) Prior Publication Data

US 2019/0388946 A1 Dec. 26, 2019

(30) Foreign Application Priority Data

Feb. 20, 2017 (NL) ..... 2018393

(51) Int. Cl.
*B21D 5/02* (2006.01)
*B21D 37/01* (2006.01)

(52) U.S. Cl.
CPC ..... *B21D 5/0209* (2013.01); *B21D 37/01* (2013.01)

(58) Field of Classification Search
CPC ..... B21D 5/002; B21D 5/02; B21D 5/0209; B21D 5/0236; B21D 5/0254; B21D 37/01;

(Continued)

(56) References Cited

U.S. PATENT DOCUMENTS 3,880,610 A * 4/1975 Long ..... H05K 3/00 29/625
4,588,339 A * 5/1986 Bilz ..... B23C 5/16 409/234

(Continued)

FOREIGN PATENT DOCUMENTS

DE 102015100655 A1 7/2016
EP 1052480 A1 11/2000

(Continued)

OTHER PUBLICATIONS

Notification Concerning Transmittal of International Preliminary Report on Patentability for PCT Application No. PCT/NL2018/050109 dated Aug. 29, 2019, 8 pages.

*Primary Examiner* — Debra M Sullivan
*Assistant Examiner* — Matthew Stephens
(74) *Attorney, Agent, or Firm* — Peter W. Schroen; Bret E. Field; Bozicevic, Field & Francis LLP

(57) ABSTRACT

The invention relates to a device (1) for securing a tool (2), in particular a bending tool, comprising a receiving. space (4) for receiving an engaging part (5) of the tool and means (9) arranged in or close to the receiving space for locating and/or communicating with the tool. The device is further provided with a first protective layer (11) at least partially separating the locating and/or communication means from the receiving space. The tool can comprise a locating and/or communication element (14) which co-acts with the locating and/or communication means and which is closed off from the surrounding area by a second protective layer (15). The invention further relates to a method for manufacturing such a securing device.

24 Claims, 4 Drawing Sheets

(58) Field of Classification Search
CPC .... B21D 37/02; G01B 7/003; B23B 2231/26; B23B 2260/128; B23B 2270/48; B23Q 3/15546; B23Q 17/006; B23Q 17/2208; B23Q 17/2216; B23Q 17/2225; G05B 2219/45143; G05B 2219/49304; Y10T 483/13; Y10T 483/132; Y10T 483/134; Y10T 483/136; Y10T 483/138
USPC ..... 72/20.1, 481.1; 73/769, 774, 855
See application file for complete search history.

(56) References Cited

U.S. PATENT DOCUMENTS 7,513,135 B2 * 4/2009 Denkmeier ..... B21D 5/02 29/867
2002/0129508 A1 * 9/2002 Blattner ..... G01D 5/2457 33/706
2004/0237617 A1 * 12/2004 Sperrer ..... B21D 5/02 72/31.1
2005/0268680 A1 * 12/2005 Bruggink ..... B21D 5/0209 72/15.1
2008/0043238 A1 * 2/2008 Bruggink ..... B23Q 17/24 356/400
2013/0327104 A1 * 12/2013 Haselboeck ..... B21D 5/0236 72/21.3
2015/0160361 A1 * 6/2015 Gondo ..... B21D 5/02 324/679
2018/0264614 A1 * 9/2018 Winkelmann ..... G01L 5/0019 33/706

FOREIGN PATENT DOCUMENTS

EP 1600256 A1 11/2005
EP 1864752 A1 12/2007
WO WO-2009117756 A1 * 10/2009 ..... B21D 5/02

* cited by examiner

DEVICE FOR SECURING A TOOL AND METHOD FOR MANUFACTURING SUCH A DEVICE

TITLE OF THE INVENTION

CROSS REFERENCE TO RELATED APPLICATION

Pursuant to 35 U.S.C. § 119, this application claims priority to the filing date of Netherlands Patent Application Serial No. 2018393 filed on Feb. 20, 2017, the disclosure of which application is herein incorporated by reference.

BACKGROUND OF THE INVENTION

The present invention relates to a device for securing a tool, in particular a bending tool, comprising a receiving space for receiving an engaging part of the tool and means arranged in or close to the receiving space for locating and/or communicating with the tool. Such a device is known, for instance from applicant's earlier patent applications EP 1 600 256 A1 or EP 1 864 752 A1.

The former patent publication EP 1 600 256 A1 describes a system for locating and identifying a bending tool which is clamped in a clamping beam of a press brake. In a first variant of the system use is made of an electrical conductor extending in an elongate receiving space of the clamping beam, and an electrical contact on the tool. In another variant capacitor surfaces are formed in the receiving space which detect the presence of the tool in capacitive manner The tool can here further comprise an identification circuit which, in order to be read, can make contact via an electrical connection with a conductor in the receiving space. The signals coming from the capacitor surfaces and the electrical conductor are read and processed by a control system of the press brake.

Described in the above-mentioned patent specification EP 1 864 752 A1 is a further development of this system wherein a wireless data transfer takes place between the tool and the clamping mechanism. In a first variant the communication takes place in optical manner, while in another variant there is communication in electromagnetic manner Both earlier systems make it possible to identify a tool in the clamping system of a press brake, so for instance to ascertain the type of tool and the dimensions thereof. The position of the tool in the clamping system can thus also be precisely determined, and data can be exchanged in 'real time' between the clamping system and the tool. On the basis of these data a control system can then check whether the tool is correct for the intended operation and is situated at the correct location. The control system can further indicate which tools must be placed at which positions in the clamping beam and can release the press brake for an operation at the moment that the tools are in the correct position. The control system can then indicate the sequence in which a workpiece must be processed by the different tools. Compared to conventional clamping systems, this system offers a great improvement in processing speed, precision and process reliability.

The securing device can be applied not only in a press brake or other machine, but also in a tool storage area. Here too position-determining of and communication with tools can be important, for instance in order to be able to find, fetch and replace tools in the storage area in an automated process.

BRIEF SUMMARY OF THE INVENTION

The invention now has for its object to improve the system described above such that it functions in reliable and disturbance-free manner under practically all conditions. According to the invention this is achieved in a device of the above described type when it is provided with a first protective layer at least partially separating the locating and/or communication means from the receiving space. Such a protective layer prevents the locating and/or communication means being damaged by protruding parts of the tool, for instance burrs. Also thus prevented is that the operation of the locating and/or communication means is affected by dust, grease or dirt which collects in the receiving space and is possibly pressed between the locating and/or communication means and the tool.

The risk of damage is reduced still further when the locating and/or communication means are arranged in a recess in a wall of the receiving space and the first protective layer at least partially closes off the recess.

In a first embodiment of the device the locating and/or communication means are wholly closed off from the receiving space by the first protective layer. It is on the other hand possible that the first protective layer leaves clear at least a part of the locating and/or communication means. This latter can be particularly practical when the locating and/or communication means do not operate in contactless manner or do so only partially.

Although the position of the tool can be determined passively by capacitive or optical detection, the engaging part of the tool can also comprise a locating and/or communication element co-acting with the locating and/or communication means. In that case it is preferred that this locating and/or communication element is at least partially closed off from the surrounding area by a second protective layer. Both components of the locating and/or communication system are thus protected against ambient influences.

For optimal protection it is here also preferred that the locating and/or communication element is arranged in a recess in the engaging part of the tool and that the second protective layer at least partially closes off the recess from the surrounding area.

For optimal protection thereof the locating and/or communication element can be wholly closed off from the surrounding area by the second protective layer. The second protective layer can on the other hand, particularly in the case of non-contactless operation, leave clear at least one part of the locating and/or communication element.

In order to reduce the risk of damage still further, it is preferred that the recess has a depth such that the first and/or second protective layer is recessed therein. The chance of contact being made with the protective layer is thus very small, while the components of the locating and/or communication system are lie even further away.

According to a first variant of the device according to the invention, the first and/or second protective layer is manufactured from a material with a hardness which is at least as great as a hardness of the tool. The first and/or second protective layer can for instance comprise a material with a Mohs hardness greater than 5, preferably greater than 6, more preferably greater than 7 and most preferably greater than 8. The respective protective layer can thus withstand damage by protruding parts, for instance burrs on the tool. This can be achieved by choosing the material of the first and/or second protective layer from the group comprising: minerals; metals, in particular hardened types of steel; ceramic materials; and glass.

According to another variant of the device according to the invention, the first and/or second protective layer is manufactured from a material with a hardness which is considerably less than a hardness of the tool. Such materials can be ductile or shock absorbing, and thus ensure protection. The material of the first and/or second protective layer is preferably a self-restoring material. Any possible damage can thus be immediately rectified, whereby the protection is maintained.

The material of the first and/or second protective layer can be chosen from the group comprising: epoxy; optionally fibre-reinforced plastics; hot melts; and organic or inorganic substances.

The tool slides very easily into the receiving space when the first and/or second protective layer is provided with a smooth top layer facing toward the receiving space. The risk of dirt or grease adhering to the respective protective layer is thus also reduced.

So as not to affect the data transfer between the tool and the securing device, the material of the first and/or second protective layer is preferably not electrically conductive, or hardly so.

When the first and/or second protective layer is arranged directly on the locating and/or communication means or on the locating and/or communication element respectively, the component of the locating and/or communication system and the associated protective layer can be mounted as one whole in the receiving space or on the tool respectively.

It is on the other hand possible to envisage the first and/or second protective layer being arranged on the locating and/or communication means or on the locating and/or communication element respectively via a carrier, in particular an adhesive layer. There is therefore a greater freedom in the choice of materials for the protective layer because the carrier then forms the connection between the protective layer and the underlying component of the locating and/or communication system.

It is in that case moreover possible that the first and/or second protective layer is releasable. The layer can in this way be replaced, for instance when it is damaged or heavily fouled.

In order to guarantee a good communication between the components of the locating and/or communication system it is preferred that the material of the first and/or second protective layer has a relatively high dielectric value.

When the receiving space is elongate, the locating and/or communication means and the first protective layer preferably extend substantially along the length of the receiving space. Tools can thus be located at any position in the receiving space and the invention can therefore be applied along the whole length of the device.

When the device has means for clamping the tool in the receiving space, these can form part of a clamping system of a machine, in particular a press.

In order to prevent damage to the components it is then preferred that the device is provided with means for detecting contact of the tool with the first protective layer, which detection means are configured to interrupt a clamping of the tool. By interrupting the clamping as soon as it is determined that the tool has made contact with the protective layer it is possible to prevent the tool further damaging the protective layer and the component situated therebehind as the clamping force increases. The protective layer does not necessarily have to take a hard and scratch-resistant form or, conversely, a ductile and self-restoring form in this embodiment, because here the layer in the first instance fulfils the function of contact detector. The protective layer is therefore an active protective layer here which, in contrast to a passive protective layer, does not have to provide mechanical resistance—although it is of course possible to envisage the contact-detecting layer nevertheless taking a hard and scratch-resistant form or, conversely, a ductile and self-restoring form.

The invention also relates to a method for manufacturing a device of the above described type. Both of the above-mentioned earlier patent specifications of applicant already implicitly describe a method for manufacturing a device for securing a tool, in particular a bending tool, comprising the steps of forming a receiving space in a securing body for receiving an engaging part of the tool and arranging means in or close to the receiving space for locating and/or communicating with the tool.

The method according to the invention is distinguished herefrom by the step of arranging a first protective layer at least partially separating the locating and/or communication means from the receiving space.

BRIEF DESCRIPTION OF THE DRAWINGS

The invention will now be elucidated on the basis of an example, wherein reference is made to the accompanying drawing, in which.

DETAILED DESCRIPTION OF THE INVENTION

Figures 1, 2:
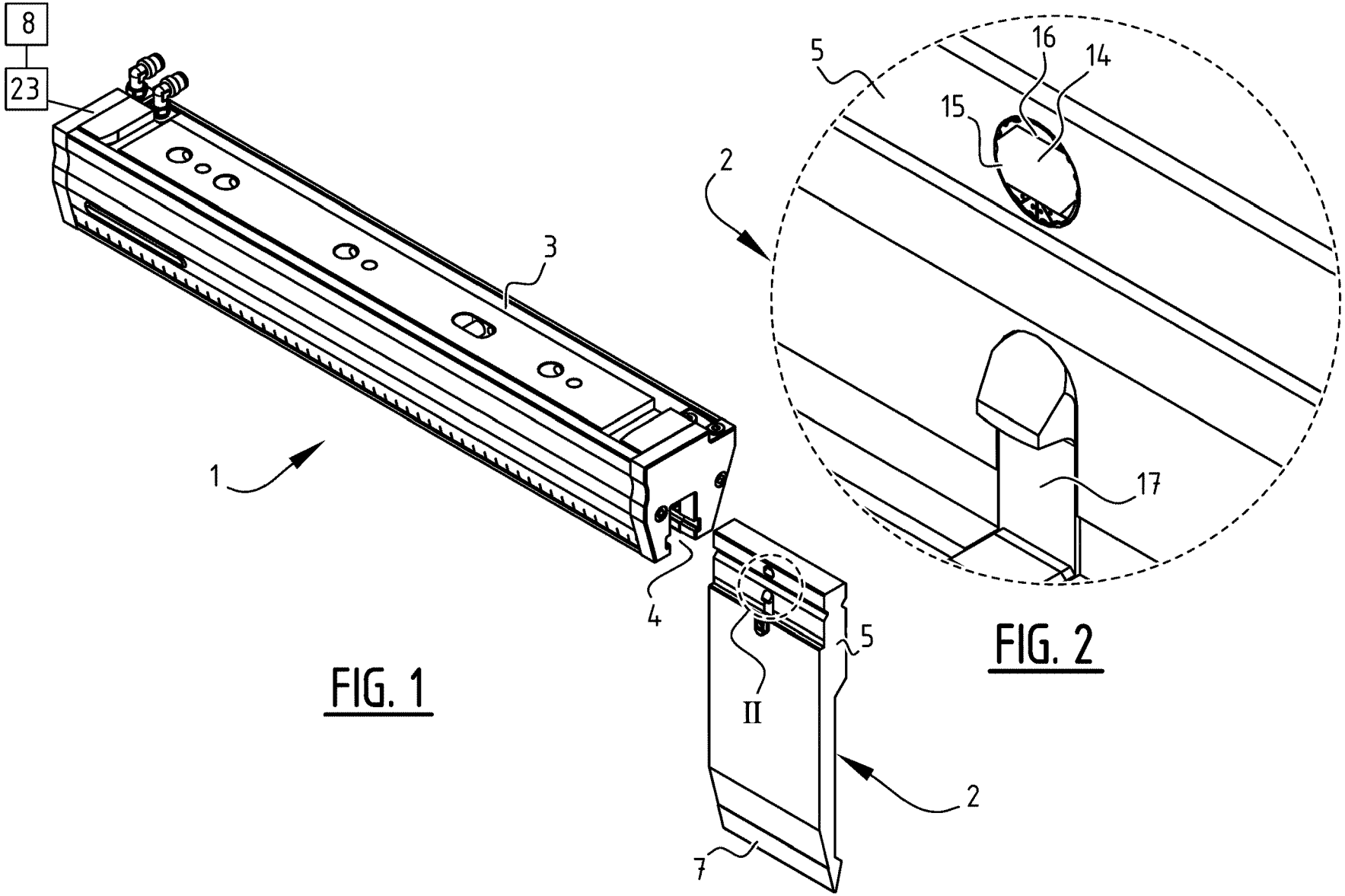
FIG. 1 is a perspective view of a device according to a first embodiment of the invention, with an upper beam in which a receiving space is defined and a tool to be clamped therein.
FIG. 2 is a detail view according to arrow II in FIG. 1.

A device 1 for securing a tool 2, in the shown example a bending tool, comprises a beam 3 in which a receiving space 4 is defined for receiving an engaging part 5 of tool 2 (FIG. 1). Receiving space 4 extends here along the whole length of beam 3. In the shown example, beam 3 is a clamping beam forming part of a clamping system of a machine, here a press brake. Engaging part 5 of tool 2 has on either side a groove 30 configured for receiving a clamping protrusion 31 to be inserted into receiving space 4. This clamping protrusion 31 is driven by a clamping mechanism 29 such as for instance described in applicant's earlier patent application WO 2010/056110 A1.

Bending tool 2 has on its end remote from engaging part 5 a nose 6 which defines a bending edge 7. The shape of bending edge 7 defines together with the shape of a lower tool to be discussed below a bending angle formed in a plate which is being processed in the press brake. In practice a product will have to undergo several bending operations, and different bending tools are clamped for this purpose adjacently of each other in beam 3.

A control system 8 gives instructions about the sequence in which operations must be carried out on the basis of design information of a product. Control system 8 also indicates which tools must be used for this purpose and where they must be placed in the press brake.

In the case of a press brake operated by an operator the instructions can take the form of light signals at the position of the clamping beam or the form of messages on a screen. In a fully automated press brake the control system can control one or more robots which place or remove the tools and which insert the workpieces into the press.

In order to give control system 8 feedback on the actual position of the different tools in clamping beam 3, device 1 is provided with means 9 for locating and/or communicating with tool 2. These locating and/or communication means 9 can take the form as described in the earlier patent documents EP 1 600 256 A1 or EP 1 864 752 A1 of applicant. In order to be able to detect the presence of tools 2 at any position in clamping beam 3 the locating and/or communication means 9 are here arranged distributed along the whole length of receiving space 4.

The locating and/or communication means comprise in practice a number of electronic and/or optical components arranged on a substrate, for instance in the form of a board with printed circuits 10 (printed circuit board—PCB). The components of the locating and/or communication means 9 are relatively vulnerable, particularly in an industrial environment where great forces are exerted. Each tool 2 is thus clamped with force in receiving space 4 of clamping beam 3. Because the dimensions of receiving space 4 are larger than those of engaging part 5 of tool 2, tool 2 can still move to some extent when it is inserted into receiving space 4, whereby there is the risk of protruding parts of tool 2 coming into contact with PCB 10. A protruding part could for instance be formed by a burr or other damage to the tool which could be pressed against the components of PCB 10 during clamping of the tool.

Figure 4:
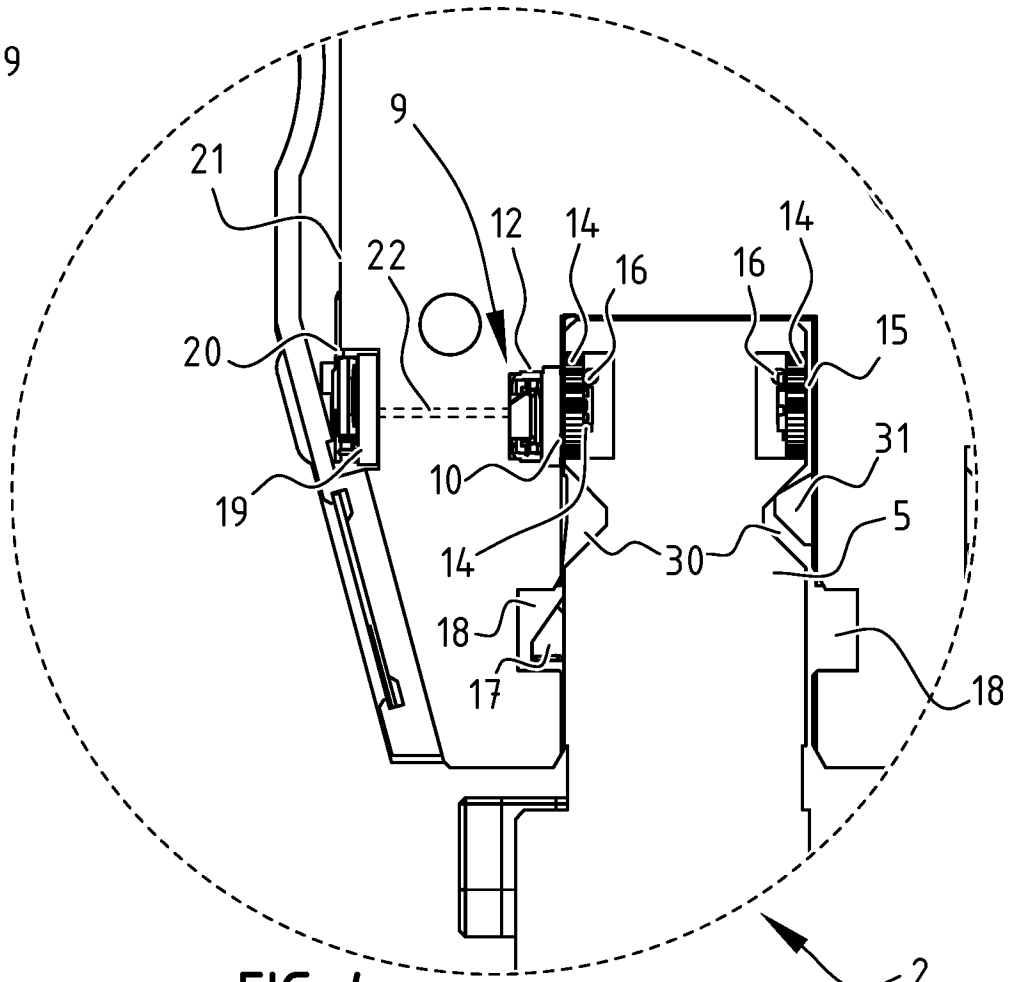
FIG. 4 is a detail view on enlarged scale according to arrow IV in FIG. 3.
Figure 3:
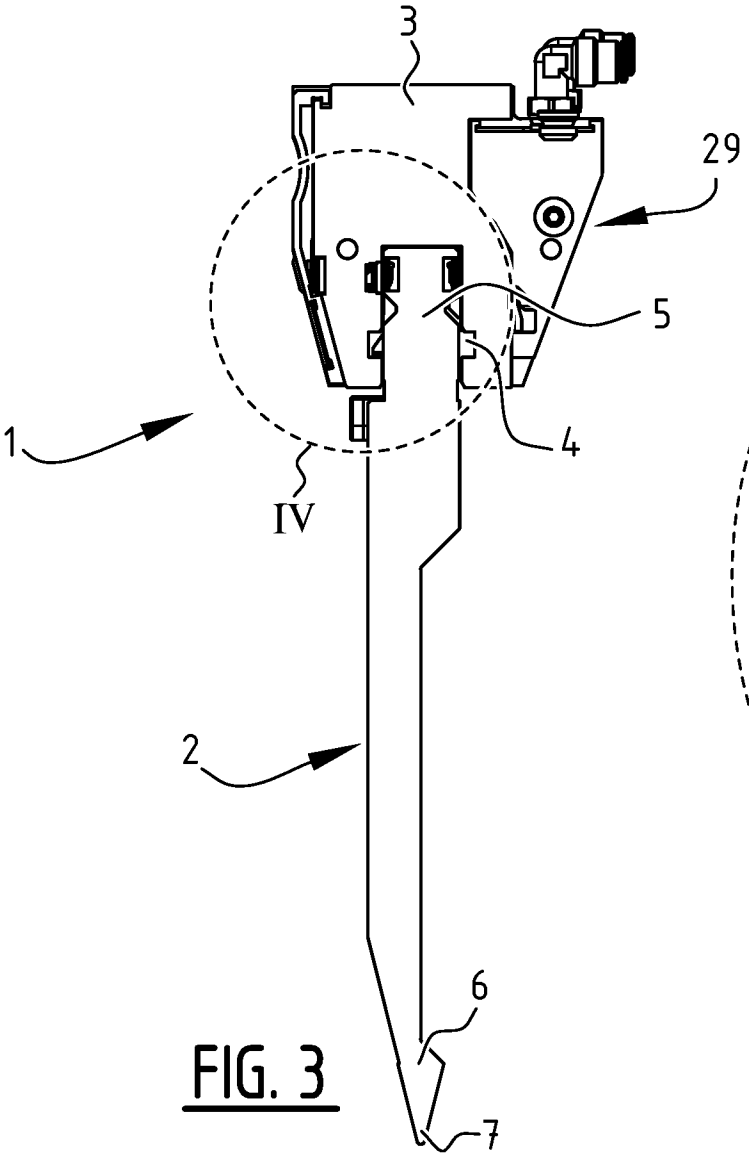
FIG. 3 shows a cross-section through the clamping device of FIG. 1 with the tool clamped therein.
Figure 6A:
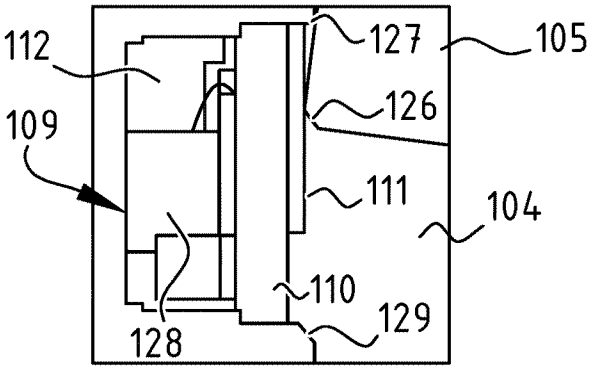
FIGS. 6A-C are detail views according to arrow VI in FIG. 5 during different stages of inserting the lower tool into the receiving space.
Figure 6B:
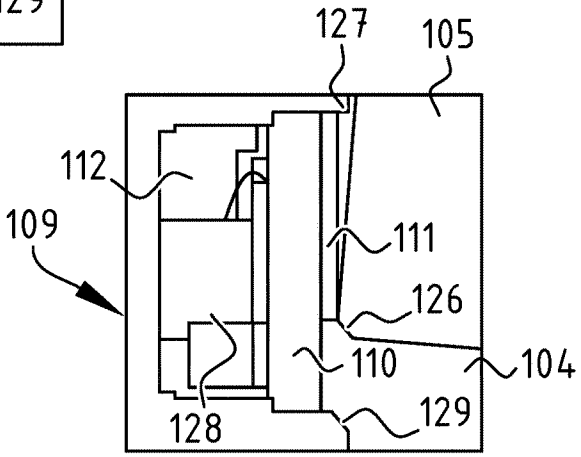
Figure 6C:
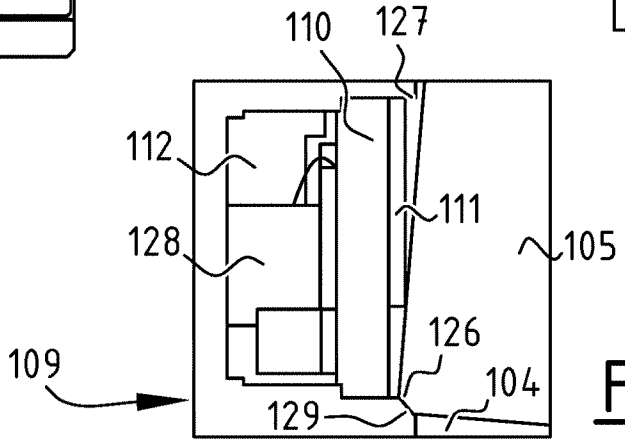
Figure 5:
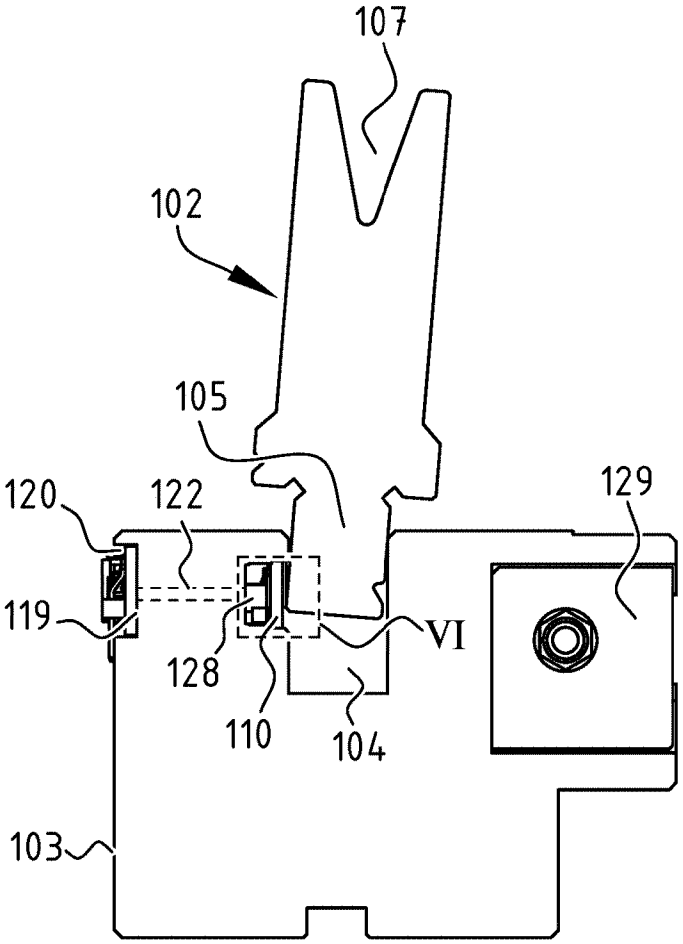
FIG. 5 shows a cross-section through a lower clamping beam in which a lower tool is placed, wherein the tool is inserted obliquely into the receiving space.
Figure 7:
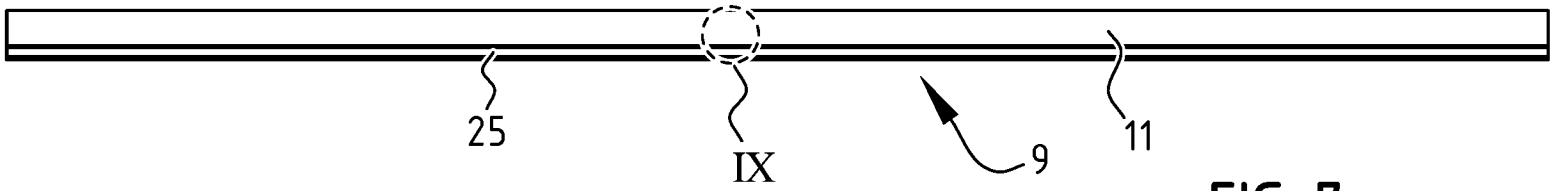
FIG. 7 is a front view of elongate locating and/or communication means with a protective layer as for instance applied in the device of FIGS. 1-4.
Figure 9:
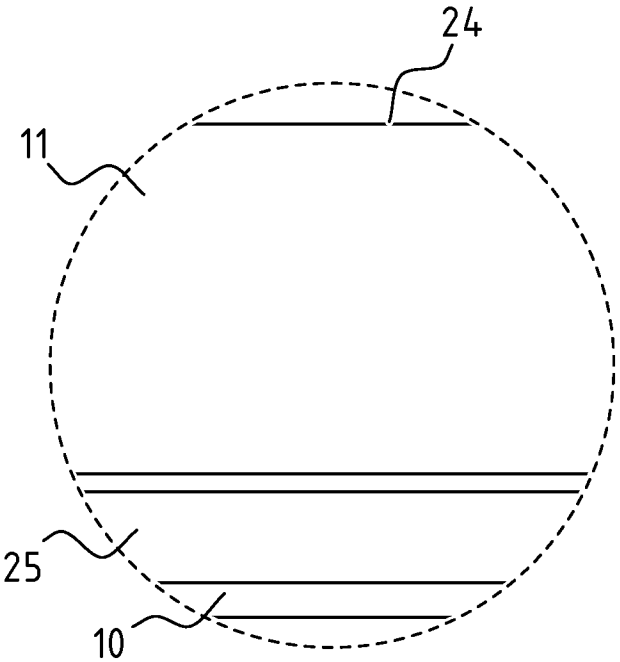
FIG. 9 shows a detail according to arrow IX in FIG. 7.
Figure 8:
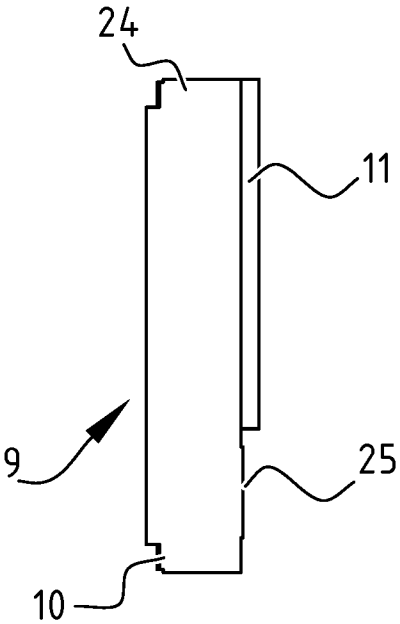
FIG. 8 is a side view on enlarged scale of the locating and/or communication means and the protective layer of FIG. 7.

In order to prevent such damage to PCB 10, device 1 according to the invention is provided with a protective layer 11, also designated hereinbelow as "first protective layer", which separates the locating and/or communication means 9 from receiving space 4. In the shown example PCB 10 of the locating and/or communication means 9 is received in an elongate recess or groove 12 extending longitudinally in a side wall 13 of receiving space 4 (FIG. 4). First protective layer 11 is arranged on PCB 10 and likewise extends along the length of receiving space 4 (FIG. 7).

Although the locating and/or communication means 9 can in principle detect the presence and even the position of tool 2 solely on the basis of changes in the environment—for instance changes in an electrical or magnetic field strength or changes in the light incidence in the case of an optical detection—tool 2 is preferably provided with a locating and/or communication element 14 which co-acts with the locating and/or communication means 9 in receiving space 4. Tool 2 can in this way not only be detected but also identified. The locating and/or communication element 14, which can take the form of a chip, can also be protected against damage by means of a protective layer of its own (or "second protective layer") 15. The chip of the locating and/or communication element 14 is here also received in a recess 16 in tool 2 and second protective layer 15 wholly or partially closes off this recess 16.

In the shown example the locating and/or communication element 14 is arranged substantially on the axis of tool 2 so that a precise indication of the position of the middle of tool 2 is hereby obtained. As can be seen, the locating and/or communication element 14 is arranged close to the upper side of tool 2, to some extent above a movable safety catch 17 of tool 2. In the shown example tool 2 is provided on either side with a locating and/or communication element 14 so that tool 2 can be clamped in two directions and can then still co-act with the locating and/or communication means 9 of device 1, which in the shown example are arranged on only one side of receiving space 4. As is usual in this type of device, safety catch 17 co-acts with a groove 18 in receiving space 4.

The locating and/or communication means 9 are here otherwise connected to control system 8 via a connection module 19. This connection module 19, which likewise extends along the whole length of clamping beam 3, is received in a groove 20 in an outer wall 21 of clamping beam 3. The connection module communicates with PCB 10 of the locating and/or communication means 9 via one or more cables 22 which pass through clamping beam 3, although a wireless connection can also be envisaged. In the shown example the connection module is not connected directly to control system 8 but via a processing unit 23. This processing unit 23 processes information coming from PCB 10 and converts it to a standard format, for instance TCP/IP or CAN for transmission to control system 8. The locating and/or communication means 9 can in this way be used in combination with different control systems. This is important because device 1 is usually supplied separately of the press brake and can be applied in press brakes of different manufacture. First protective layer 11 does not form a complete separation between PCB 10 and receiving space 4 in the shown example. Protective layer 11 extends from an upper side 24 of the PCB only along a part of the height thereof and leaves a part of PCB 10 exposed on the underside. On this exposed part a conductive strip 25 is formed whereby electrical connection can be made with an electrical contact present on tool 2. The risk of damage to the side of PCB 10 not covered by first protective layer 11 is slightly lower because tool 2 in the shown example is an upper tool which is inserted into receiving space 4 from the underside. The exposed lower part of PCB 10 is protected to some extent here by the lower edge of groove 12, particularly when PCB 10 is arranged recessed to some extent therein.

This can be clearly seen in FIG. 5 and FIGS. 6A-C in which a lower tool 102 is shown. This lower tool 102, which is provided on its upper side with a groove 107 which co-acts with nose 6 of upper tool 2, is received in a receiving space 104 in a lower beam 103, in this example the lower clamping beam of clamping device 1. Also provided here are locating and/or communication means 109 comprising, among other parts, a PCB 110 received in an elongate recess or groove 112 in a side wall 113 of receiving space 104. In this case PCB 110 is provided with a protective layer 111 only on its upper side, since the lower part of PCB 110 is beyond the reach of end edge 126 of lower tool 102. This part is protected by upper and lower edge 127, 129 of groove 112 and by the lower edge of protective layer 111. It is on the other hand possible to envisage arranging an electrically conductive protective layer (not shown here) in the space below the non-conductive protective layer 111, whereby PCB 110 is additionally protected while electrical contact with conductive strip 125 is still possible. This figure also shows components 128 on PCB 110 of the locating and/or communication means 109 more clearly than the drawing of the upper clamping. The locating and/or communication means 109 here also further comprise a connecting module 119 received in a groove 120 and connected via cabling 122 to PCB 110.

Although not shown here, lower tool 102 can of course also be provided with a locating and/or communication element for co-action with the locating and/or communication means 109. Such a locating and/or communication element can then likewise be shielded from the surrounding area by means of a protective layer.

The material of first protective layer 11, 111 can be at least as hard as the steel from which tool 2, 102 is manufactured. Suitable materials in this respect are extra hard and scratch-resistant glass, for instance so-called Gorilla® Glass or Willow® Glass from Corning (www.corning.com) or corresponding glass types such as Dragontrail™ from Asahi (www.agc.com) or sapphire glass from GTAT (www.gtat-.com) or ceramic material. Glass is of course the material of choice when the communication between the PCB and tool 2 takes place by optical means. A very good protection is achieved by making use of a material for the protective layer which is harder than the steel of the tool.

Another possibility is to make use of a material for the protective layer which is less hard than the tool steel, but which is ductile and shock-absorbing. High loads on PCB 10 are damped by applying such a material, while the protective layer will moreover possibly yield, but will not crack wholly open or be pierced by projections on the tool. When a self-restoring material is chosen as material of the protective layer, the protective layer will recover its original form after the load of the tool has been removed and will provide the same protection as before it came into contact with the projection on the tool. Suitable materials in this respect are epoxy, optionally fibre-reinforced plastics, hot melts, and organic or inorganic substances. The protective layer can be further provided with a smooth top layer in order to prevent adhesion of dirt and grease and to ensure that the tool can slide in the receiving space with minimal friction, whereby the risk of damage is further reduced.

The material of the protective layer can have a high dielectric value in order to enable localization on the basis of capacitive detection.

In addition or as alternative to the mechanical protection provided by the protective layer, clamping device 1 can be further provided with an electronic safety mechanism. For this purpose a pressure-sensitive layer (not shown here) can be arranged on PCB 10, 110 which generates a signal when the PCB is subjected to a load. Control system 8 can then interrupt the clamping on the basis of this signal, whereby the load does not increase further. The consequences of unintentional contact between tool 2, 102 and PCB 10, 110 are thus limited as far as possible. The pressure value resulting in a warning signal must be chosen here such that normal contact between the tool and conductive strip 25, 125 of the PCB does not result in a warning signal. It is possible in this respect to envisage the pressure-sensitive layer being arranged only on that part of PCB 10, 110 on which protective layer 11, 111 is also present. It is also possible to envisage protective layer 11, 111 itself forming the pressure-sensitive layer. It is then not strictly necessary for protective layer 11, 111 to also offer mechanical resistance; the layer could function solely as pressure-sensitive sensor which generates the signal for the electronic safety. A similar provision could otherwise be arranged in tool 2, 102, in order to additionally safeguard the locating and/or communication element 14, 114 against damage.

The protective layer can be arranged directly on PCB 10, 110, for which purpose use can be made of any suitable technique. It is however also possible to arrange a carrier or intermediate layer between protective layer 11, 111 and PCB 10, 110, for instance a glue layer or other adhesive layer (not shown here). It is in this way possible to release protective layer 11, 111 again from PCB 10, 110 after a period of time, for instance because protective layer 11, 111 is damaged or fouled. The whole PCB 10, 110 does not therefore have to be replaced following damage to the protective layer.

Although the invention has been elucidated above on the basis of a number of embodiments, it will be apparent that it is not limited thereto but can be varied in many ways.

The protective layer can thus be arranged over the whole surface of the PCB when there is no necessity to form a direct electrical contact between the tool and the PCB. Different protective layers can also be combined, for instance a protective layer of hardened, scratch-resistant glass for the locating and/or communication means 9 in upper beam 3 and a protective layer of a ductile, absorbing or self-restoring material on the locating and/or communication means 109 in lower beam 103. The protective layers in the clamping beam and the protective layer in the tool can also be different. Several protective layers can further be arranged one over another, for instance a layer of ceramic material covered by a ductile or self-restoring layer or vice versa. And finally, passive and active protective layers can be combined.

The locating and/or communication means and the locating and/or communication element can in addition be arranged at other positions in the receiving space and on the tool respectively. The protective layers will consequently also be arranged at other positions. And although the securing device is described here as a clamping device forming part of a machine, here a press brake, it can also be applied in other environments, for instance in a storage area where tools are likewise placed in receiving spaces with their engaging parts.

The invention, which is described here in association with so-called "New Standard" tools and receiving spaces shaped therefor, can finally also be applied in combination with other types of tool, such as "America Style", "European Style", "RFA Style" and the like, which each require a specifically shaped receiving space. In addition, the beam with clamping mechanism shown here as upper beam can also be used as lower beam for clamping lower tools, wherein the invention can likewise be applied.

The scope of the invention is therefore defined solely by the following claims.

The invention claimed is:

1. Tool securing beam for securing a bending tool, comprising:

a receiving space for receiving an engaging part of the tool, said receiving space extending along the whole length of the tool securing beam;

an elongate recess extending longitudinally in a wall of the receiving space;

a locating and/or communication unit arranged in the recess for locating and/or communicating with the tool; and a first protective layer partially separating the locating and/or communication unit from the receiving space, wherein the first protective layer is configured to protect the locating and/or communication unit from being damaged by the tool, the first protective layer extending from an upper side of the locating and/or communication unit only along a part of a height thereof, leaving exposed only a lower part of the locating and/or communication unit, and wherein a conductive strip is formed on the exposed lower part of the locating and/or communication unit, said conductive strip being configured to form a direct electrical connection with an electrical contact present on the bending tool for partially non-contactless operation.

2. Tool securing beam as claimed in claim 1, wherein the recess has a depth such that the first protective layer is recessed therein.

3. Tool securing beam as claimed in claim 1, wherein the first protective layer is manufactured from a material with a hardness which is at least as great as a hardness of steel.

4. Tool securing beam as claimed in claim 3, wherein at least one of:

the first protective layer comprises a material with a Mohs hardness greater than 5; and/or the material of the first protective layer is chosen from the group comprising: minerals; metals; ceramic materials; and glass.

5. Tool securing beam as claimed in claim 3, wherein the material of the first protective layer is not electrically conductive.

6. Tool securing beam as claimed in claim 1, wherein the first protective layer is manufactured from a material with a hardness which is less than a hardness of steel.

7. Tool securing beam as claimed in claim 6, wherein at least one of:

the material of the first protective layer is a self-restoring material; and/or the material of the first protective layer is chosen from the group comprising: epoxy; plastics; hot melts; and organic or inorganic substances.

8. Tool securing beam as claimed in claim 6, wherein the first protective layer is provided with a smooth top layer facing toward the receiving space.

9. Tool securing beam as claimed in claim 1, wherein one of:

the first protective layer is arranged directly on the locating and/or communication unit; or the first protective layer is arranged on the locating and/or communication unit via a carrier.

10. Tool securing beam as claimed in claim 1, wherein the locating and/or communication unit and the first protective layer extend substantially along the length of the receiving space.

11. Device as claimed in claim 1, further comprising at least one of:

at least one clamp for clamping the bending tool in the receiving space, wherein the tool securing beam forms part of a clamping system of a press; and/or a system for detecting contact of the tool with the first protective layer, which detection system is configured to interrupt a clamping of the tool.

12. Combination of a tool securing beam as claimed in claim 1 and a bending tool for securing therein, wherein the bending tool comprises an engaging part for receipt in a receiving space of the tool securing beam and a nose or groove on an end remote from the engaging part, wherein the engaging part comprises a locating and/or communication element co-acting with a locating and/or communication unit of the tool securing beam, wherein the locating and/or communication element is partially closed off from the surrounding area by a second protective layer, wherein the second protective layer is configured to protect the locating and/or communication element from being damaged by the tool securing beam, and wherein the second protective layer leaves clear a part of the locating and/or communication element, the part left clear including an electrical contact, said electrical contact being configured to form a direct electrical connection with a conductive strip formed on an exposed part of the locating and/or communication unit of the tool securing beam for partially non-contactless operation.

13. Combination as claimed in claim 12, wherein the locating and/or communication element is arranged in a recess in the engaging part and the second protective layer partially closes off the recess from the surrounding area.

14. Combination as claimed in claim 13, wherein the recess has a depth such that the second protective layer is recessed therein.

15. Combination as claimed in claim 12, wherein the second protective layer is manufactured from a material with a hardness which is at least as great as a hardness of steel.

16. Combination as claimed in claim 15, wherein at least one of:

the second protective layer comprises a material with a Mohs hardness greater than 5; and/or the material of the second protective layer is chosen from the group comprising: minerals; metals; ceramic materials; and glass.

17. Combination as claimed in claim 15, wherein the material of the second protective layer is not electrically conductive.

18. Combination as claimed in claim 12, wherein the second protective layer is manufactured from a material with a hardness which is less than a hardness of steel.

19. Combination as claimed in claim 18, wherein at least one of:

the material of the second protective layer is a self-restoring material; and/or the material of the second protective layer is chosen from the group comprising: epoxy; plastics; hot melts; and organic or inorganic substances.

20. Combination as claimed in claim 18, wherein the second protective layer is provided with a smooth top layer facing toward the receiving space.

21. Combination as claimed in claim 12, wherein one of:

the second protective layer is arranged directly on the locating and/or communication element; or the second protective layer is arranged on the locating and/or communication element via a carrier.

22. Method for manufacturing a tool securing beam for securing a bending tool, comprising the steps of:

a) forming a receiving space in a beam for receiving an engaging part of the tool, said receiving space extending along the whole length of the beam, b) forming an elongate recess extending longitudinally in a wall of the receiving space, c) arranging a locating and/or communication unit in the recess in the wall of the receiving space for locating and/or communicating with the tool, and d) arranging a first protective layer partially separating the locating and/or communication unit from the receiving space, wherein the first protective layer is configured to protect the locating and/or communication unit from being damaged by the tool, the first protective layer extending from an upper side of the locating and/or communication unit lower edges only along a part of a height thereof, leaving exposed only a lower part of the locating and/or communication unit, and wherein the method further comprises the step of forming a conductive strip on the exposed lower part of the locating and/or communication unit, said conductive strip being configured to form a direct electrical connection with an electrical contact present on the bending tool for partially non- contactless operation.

23. Method as claimed in claim 22, wherein in step b) the recess is formed with a depth such that the first protective layer can be arranged recessed therein.

24. Method as claimed in claim 22, wherein one of:

the first protective layer is arranged directly on the locating and/or communication unit or the first protective layer is arranged on the locating and/or communication unit by placing a carrier therebetween.

* * * * *